US009770618B2

(12) United States Patent
Wall

(10) Patent No.: US 9,770,618 B2
(45) Date of Patent: Sep. 26, 2017

(54) THREE SECTIONED CONFIGURABLE EXERCISE APPARATUS

(71) Applicant: James Lee Wall, McKenney, VA (US)

(72) Inventor: James Lee Wall, McKenney, VA (US)

( * ) Notice: Subject to any disclaimer, the term of this patent is extended or adjusted under 35 U.S.C. 154(b) by 0 days.

(21) Appl. No.: 15/220,752

(22) Filed: Jul. 27, 2016

(65) Prior Publication Data

US 2017/0100622 A1 Apr. 13, 2017

Related U.S. Application Data

(60) Provisional application No. 62/240,921, filed on Oct. 13, 2015.

(51) Int. Cl.

| | |
|---|---|
| ***A63B 21/02*** | (2006.01) |
| ***A63B 21/055*** | (2006.01) |
| ***A63B 71/00*** | (2006.01) |
| *A63B 21/002* | (2006.01) |
| *A63B 21/072* | (2006.01) |
| *A63B 23/12* | (2006.01) |
| *A63B 21/00* | (2006.01) |

(52) U.S. Cl.

CPC ..... *A63B 21/0557* (2013.01); *A63B 21/0552* (2013.01); *A63B 21/4029* (2015.10); *A63B 71/0036* (2013.01); *A63B 21/0023* (2013.01); *A63B 21/0724* (2013.01); *A63B 21/4035* (2015.10); *A63B 21/4047* (2015.10); *A63B 23/1209* (2013.01); *A63B 2210/50* (2013.01)

(58) Field of Classification Search

CPC ..... A63B 21/0023; A63B 21/0557; A63B 21/0552; A63B 21/0724; A63B 21/4029; A63B 21/4047; A63B 21/4035; A63B 23/1209; A63B 71/0036; A63B 2210/50

See application file for complete search history.

(56) References Cited

U.S. PATENT DOCUMENTS

| | | | | |
|---|---|---|---|---|
| 5,575,742 | A * | 11/1996 | Wu | A63B 23/0211 482/142 |
| 6,245,001 | B1 * | 6/2001 | Siaperas | A63B 21/04 482/123 |
| 6,454,683 | B1 * | 9/2002 | Kaye | A47B 83/045 482/142 |
| 6,634,998 | B2 * | 10/2003 | Siaperas | A63B 21/04 482/123 |
| 6,908,417 | B2 * | 6/2005 | Jackson | A63B 21/0552 482/123 |
| 7,311,642 | B2 * | 12/2007 | Li | A63B 23/0458 297/135 |

* cited by examiner

*Primary Examiner* — Joshua Lee
*Assistant Examiner* — Megan Anderson
(74) *Attorney, Agent, or Firm* — Dunlap Bennett & Ludwig PLLC

(57) ABSTRACT

A three sectioned configurable exercise box. The sections may be configured to turn the exercise into standup or bench supported resistance band workout station. The system occupies a fraction of the size and price of any comparable home gym and free weight system.

11 Claims, 5 Drawing Sheets

THREE SECTIONED CONFIGURABLE EXERCISE APPARATUS

CROSS-REFERENCE TO RELATED APPLICATION

This application claims the benefit of priority of U.S. provisional application No. 62/240,921, filed Oct. 13, 2015, the contents of which are herein incorporated by reference.

BACKGROUND OF THE INVENTION

The present invention relates exercise equipment, and more particularly to apparatus that are configurable to perform various exercises.

Currently, people who wish to exercise have a range of options to maintain their personal fitness. Gym memberships can be expensive and many people prefer working out in the privacy of their own home. That too may also be expensive as complete home gym sets are quite costly. In addition, currently available home gym systems and free weights are too large and take up a great deal of floor space that typically must be committed to use as a fitness area. Moreover, the equipment is not very attractive, presenting an eyesore.

As can be seen, there is a need for a complete fitness system that is a fraction of the size and price of any comparable home gym and free weight system.

SUMMARY OF THE INVENTION

In one aspect of the present invention, an configurable exercise apparatus, includes: a first section formed as an elongate plate having a substantially flat first side surface and a plurality of attachment points extending from a second side surface; a second section having opposed upstanding sidewalls, an top opening at an upper end of the sidewalls, a bottom opening at a lower end of the sidewalls, wherein the first section is configured to be removably received in the top opening as a closure of the top opening when the apparatus is configured in a stowed condition; and a third section having a base with an upstanding frame wall extending interiorly from a periphery of the base, the frame wall dimensioned to support a bench back rest and a bench seat, and to be received within the bottom opening of the second section when the apparatus is configured in a stowed condition. In some embodiments, the apparatus may include a pair of ground transport wheels operatively attached to at least one end of the apparatus.

In a preferred embodiment, the plurality of attachment points extend a first end portion and a second end portion of the second surface. In other embodiments, the second surface further comprises a slot separating the first end portion and the second end portion from an intermediate portion. The second section may also have a notch formed in a bottom edge surface of the sidewalls, the notch is dimensioned to receive the intermediate portion of the first section; and the slot is dimensioned to receive the bottom edge surface of the sidewalls within the notch.

In certain embodiments, the third section has a peripheral lip extending from a lateral edge surface of the base, wherein a bottom surface of peripheral lip is supported by the top edge surface of the sidewalls when the third section is configured on top of the second section. In other embodiments, the third section further comprises a peripheral lip extending from a lateral edge surface of the base, wherein the a top surface of peripheral lip supports the bottom edge surface of the sidewalls when the second section is configured on top of the third section.

In other aspects of the invention, the bench back rest is pivotally attached to the bench seat. The second section may also be provisioned with a storage tray supported within an interior cavity of the second section. The configurable exercise apparatus may also include an exercise accessory including a band, a handle, and a snap link. The exercise accessory is secured to at least one of the plurality of attachment points.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a complete home fitness system in a box that is configurable for a wide range of exercise regimens and may be conveniently stowed back into a compact and attractive container when not in use.

Figure 1:
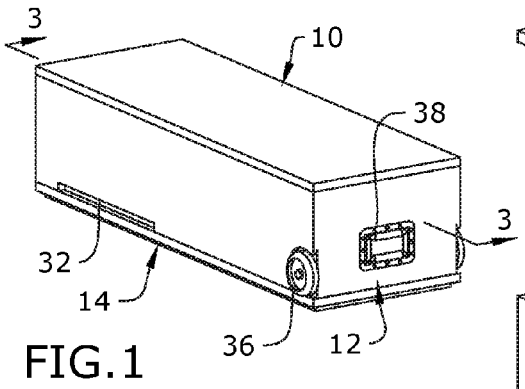
FIG. 1 is a perspective view of the invention shown in compact configuration.
Figure 2:
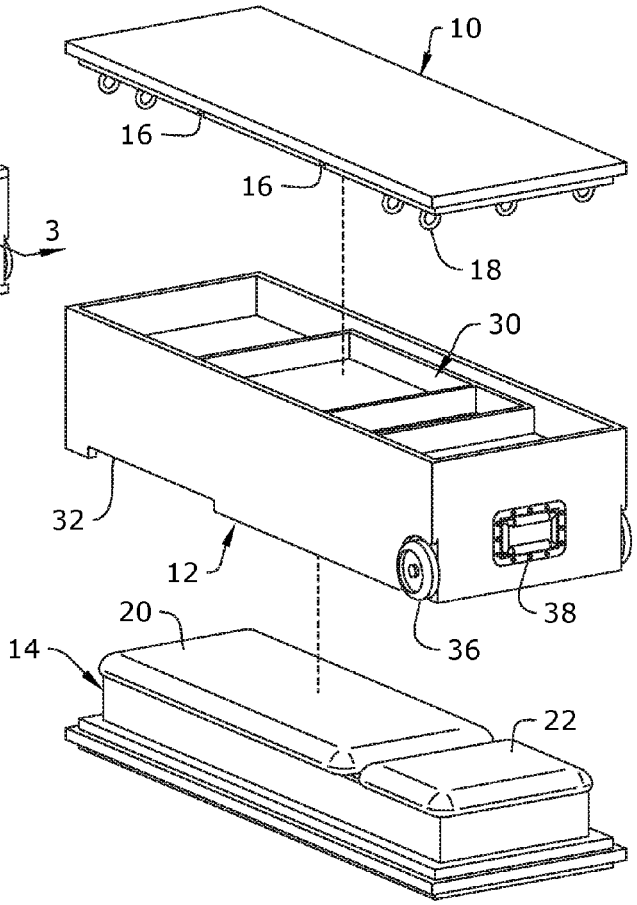
FIG. 2 is an exploded view of the invention.
Figure 3:
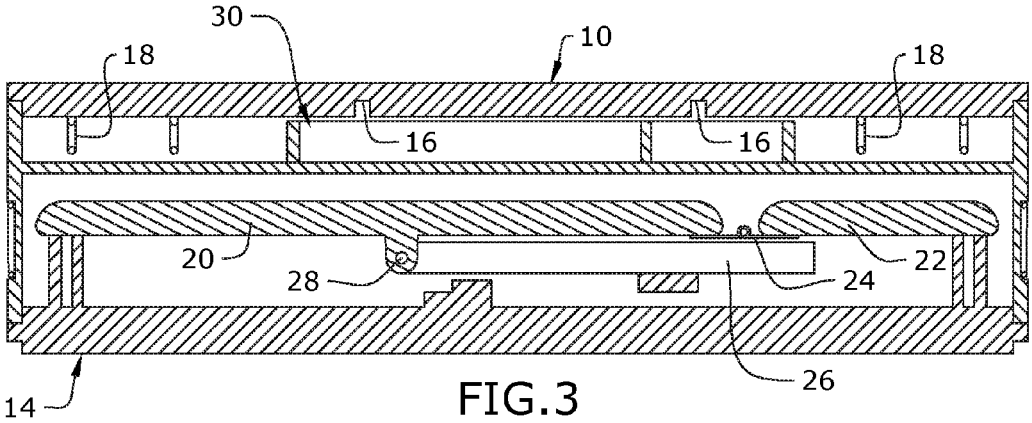
FIG. 3 is a section view of the invention taken along line 3-3 in FIG. 1.

As seen in reference to FIGS. 1-3, an embodiment of a configurable boxed home fitness system is illustrated. The configurable boxed fitness system includes three primary components: an first section 10 that serves as a cover for the system when a stowed configuration, a second section 12, that serves as a storage container for accessories and components of the system when configured in a stowed condition, and a bottom section 14 that forms a base for the system when configured in a stowed condition. As seen in reference to FIG. 3, all the components of the system are dimensioned so that they may be neatly connected and configured as a visually attractive box in a stowed condition. While the components of the sections 10, 12, 14 may be formed from any suitable materials, such as plastics, composites, metal, or wood, the present invention presents a visually attractive and durable system when fabricated of wood with a suitable stain and finish applied.

The first section 10 is formed as an elongate plate that has a substantially flat first surface that forms a top cover for the apparatus when stowed. As seen in reference to FIGS. 4 and 5, the second surface is configured as an attachment station with a plurality of spaced apart attachment points 18, such as ring bolts or screws, or loops, extending from the second surface at a first end portion and a second end portion of the first section 10. The attachment points 18 provide for the attachment of one or more exercise accessories, such as a band 40, a handle 42, and a snap link 44. The first section has a peripheral ledge surface 11 for engagement with the second section 12.

The band 40, may be formed of an elastic or resilient material to perform variable resistance exercises. The bands 40 may have various grades of elasticity to provide a selectable resistance. Similarly, the bands may be combined with one or more additional bands 40 for increasing the resistance of an exercise. The band 40 may also be formed of an inelastic material in order to perform isometric exercises. As will be appreciated, the bands 40 may be formed in various lengths that are adapted to a particular exercise or a height of the user. The handle 42 may include any of a conventional exercise handle, including a single handed grip, a two handed straight bar. The handles are attachable to the bands 40 and the attachment points 18 via one or more snap links 44.

An intermediate portion of the second surface is substantially flat so that the first section 10 may be configured with the second section 12 and the bottom section 14 for various exercise regimen setups. A pair of transverse slots 16 may be defined across the second surface to facilitate configuration of the first section 10 with the middle 12 and bottom 14 sections.

The second section 12 is a substantially box like configuration having a plurality of sidewalls and an opening at the top end and a bottom end of the sidewalls. One or more storage trays 30 having one or more bins may be carried within the second section 12. The storage tray 30 may be utilized to hold the exercise accessories for the system. A notch 32 may be formed along a bottom edge of opposed lateral sidewalls of the second section 12 at a first end portion of the second section 14. The notch 32 is dimensioned to receive the intermediate portion of the first section 10 therein and the slots 16 of the upper section are dimensioned to receive the bottom edge of the opposed lateral sidewalls within the notch 32 for certain configurations of the exercise system.

The third section 14 is configured as an adjustable exercise bench assembly 14. The bench assembly 14 includes an articulating back rest portion 20 moveably connected to a bottom or seat 22 of the bench via a hinge 24. A base portion 21 is substantially rectangular in shape and has a lip 23 extending around a peripheral edge of the base. A top surface of the lip 23 is dimensioned to support the lower sidewall edges of the second section 12 in a stowed condition and to be supported by the upper sidewall edges of the second section 12 in certain exercise configurations of the system.

A pair of ground transport wheels 36 may be attached to an end of the second section 12 or the third section 14 to facilitate repositioning of the system. The system may be configured with a handle 38 attached to at least one end of the system to facilitate repositioning and lifting of the system. The system may be readily transported from one location to another.

One or more frame walls 25 may be formed to upwardly extend from a top surface of the base portion 21 and is dimensioned to provide a subjacent support structure for the bench back rest portion 20 and the bench seat portion.

A support arm 26 may be pivotally attached to the back rest portion 20 via pivot 28, which may be a hinge or a pin. One or more adjustment stops 34 may also be provided on the top surface of the base portion 21 to engage with a free end of the support arm 26 to provide an adjustment for an angle of incline for the back rest portion 20.

Figure 4:
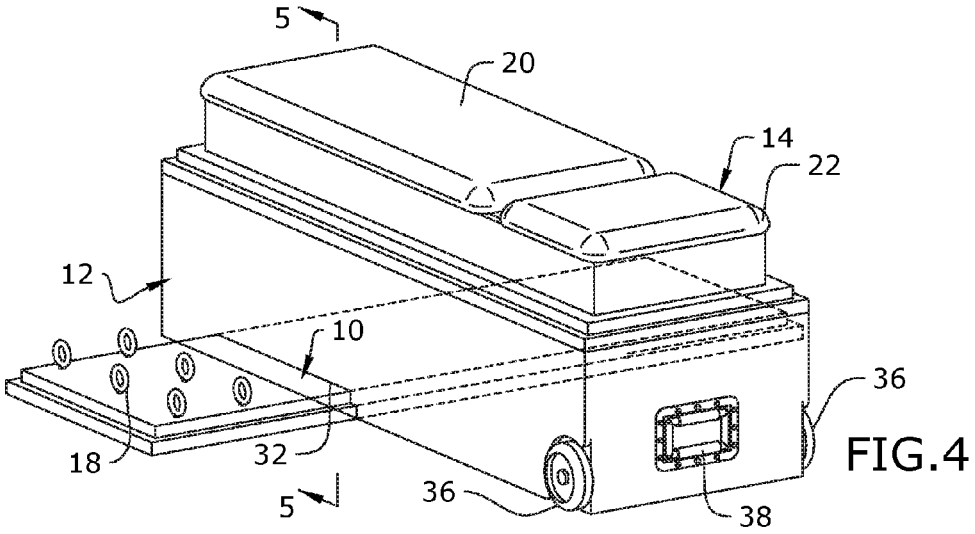
FIG. 4 is a perspective view of the invention shown in an alternate configuration.
Figure 5:
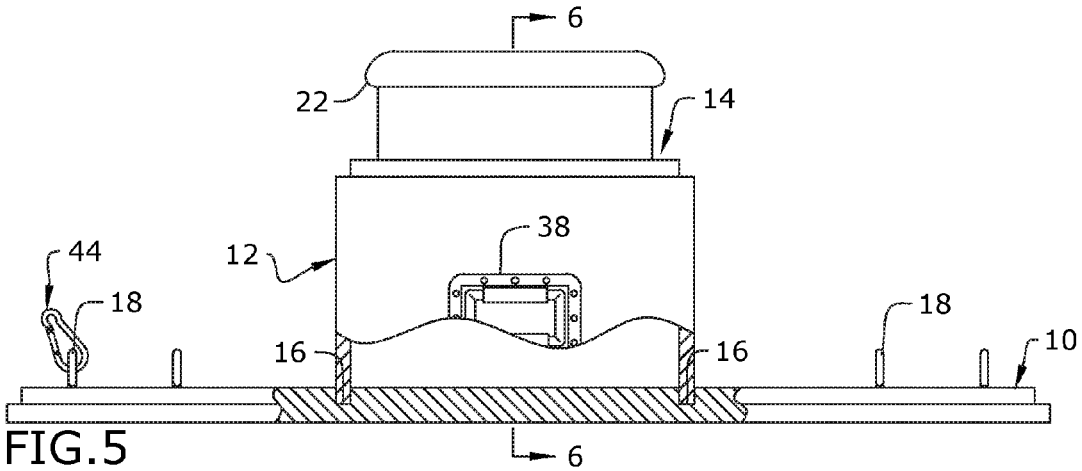
FIG. 5 is a section detail view of the invention taken along line 5-5 in FIG. 4.
Figure 6:
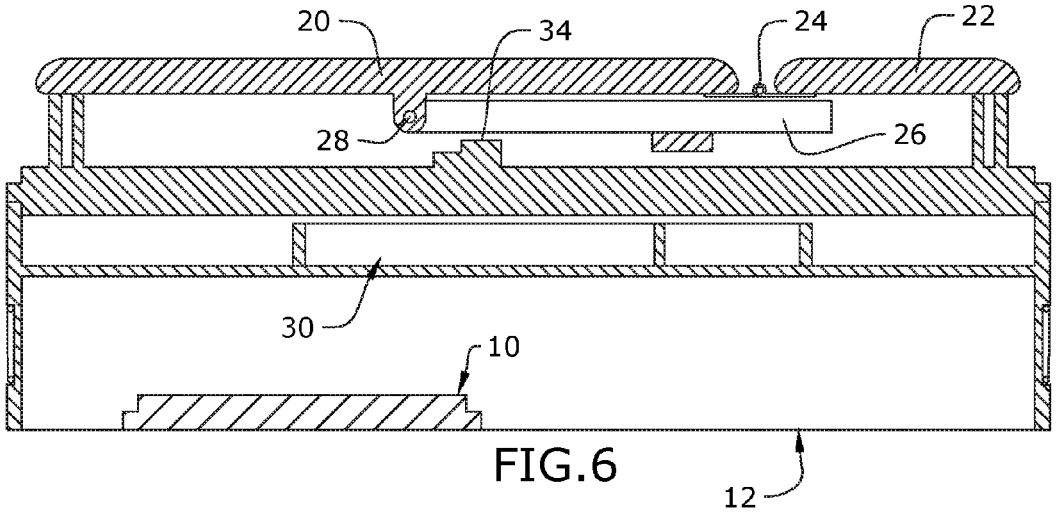
FIG. 6 is a section view of the invention taken along line 6-6 in FIG. 5.

A first exercise configuration of the system is illustrated in reference to FIGS. 4-6. The first section 10 is positioned on a floor surface and is disposed substantially perpendicular to a longitudinal length of the second section 12. The first section 10 is received within the notch 32 of the second section 12. The edge surface of the notch 32 is received within the slots 16. The third section 14 is supported by the sidewalls of the second section 12. With this configuration the second section 12 and the first section 10 are secured to permit exercises to be perform by a user utilizing the bench. One or more of the exercise accessories may be attached to the attachment points to configure the apparatus for performing exercises. In this configuration the bench back rest 20 is positioned in a reclined position.

Figure 7:
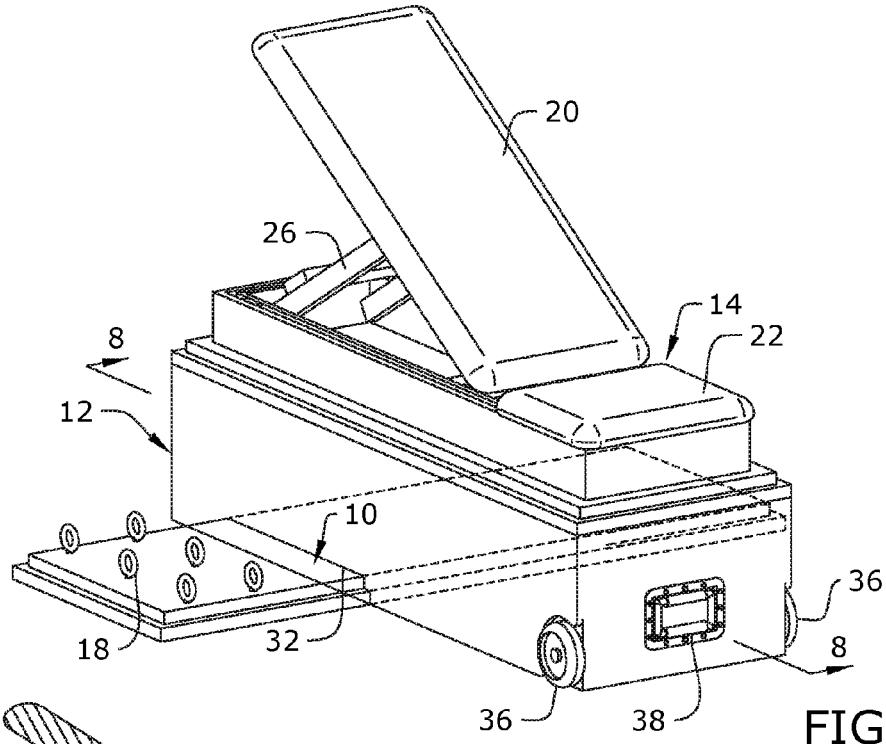
FIG. 7 is a perspective view of the invention shown in an alternate configuration.
Figure 8:
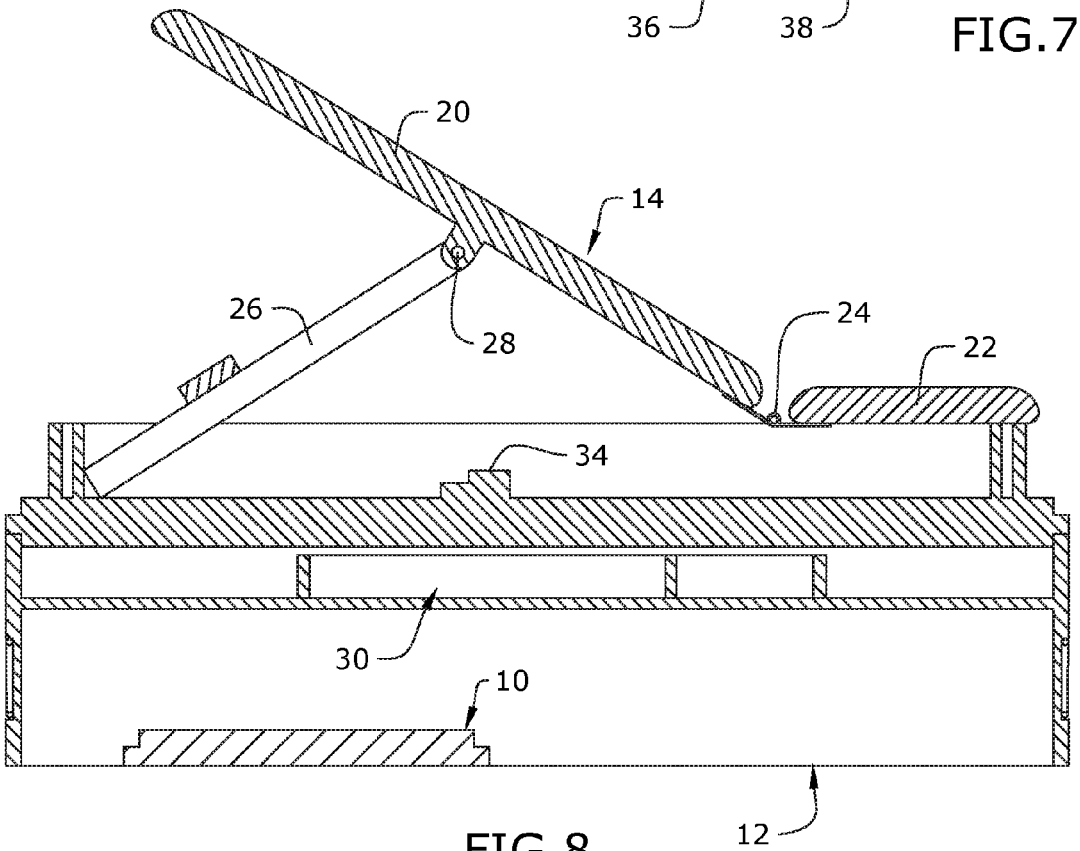
FIG. 8 is a section view of the invention taken along line 8-8 in FIG. 7.

A second exercise configuration is shown in reference to FIGS. 7-8. In this configuration, the back rest 20 is positioned in a first elevated condition, with the free end of the support arm 26 positioned in abutment with an interior surface of the frame walls 25. This position is acceptable for performing an inclined press, an inclined curl, an inclined butter fly and other exercises.

Figure 9:
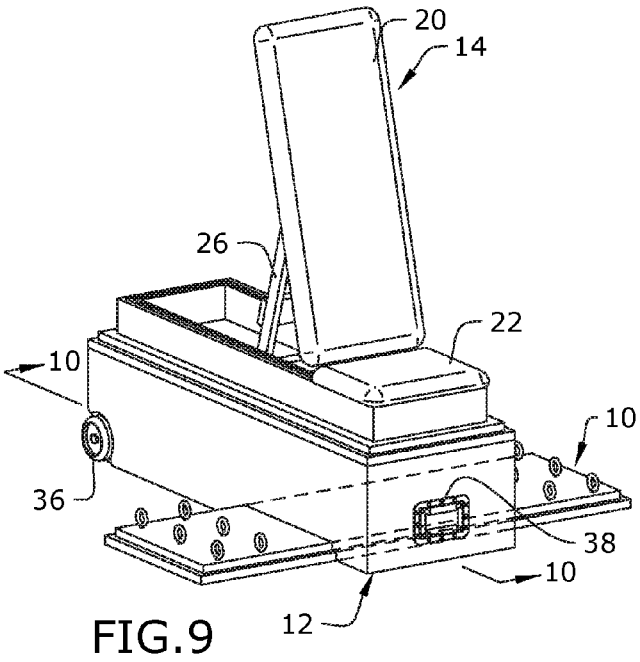
FIG. 9 is a perspective view of the invention shown in an alternate configuration.
Figure 10:
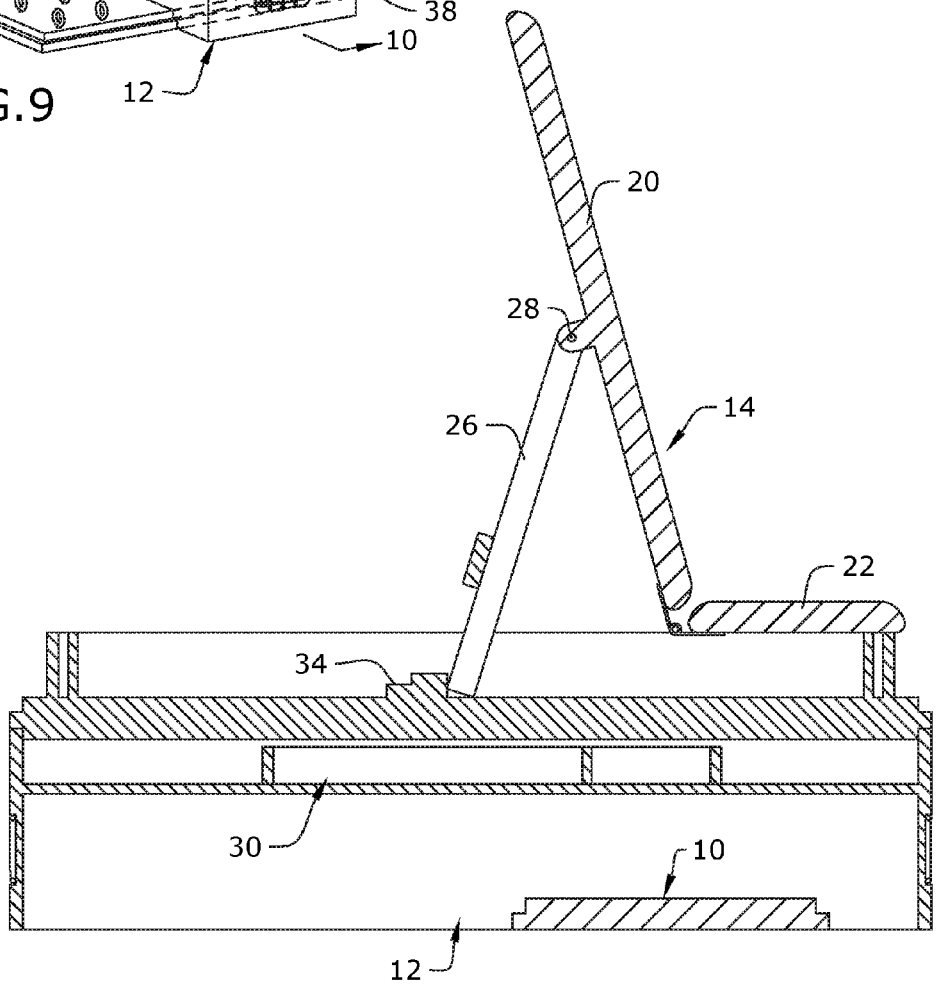
FIG. 10 is a section view of the invention taken along line 10-10 in FIG. 9.
Figure 11:
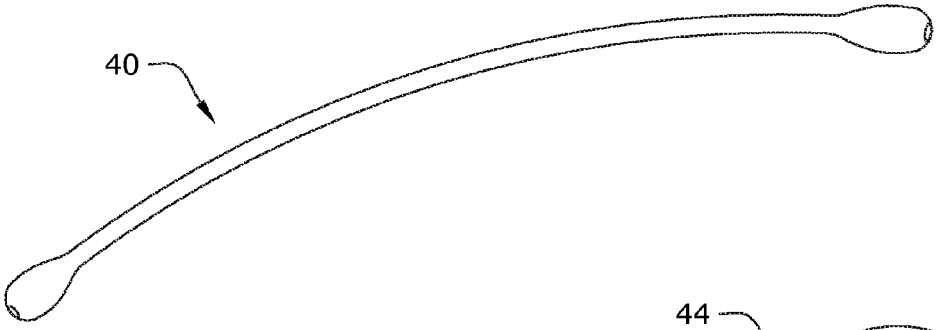
FIG. 11 is a representative embodiment of a band.
Figure 12:
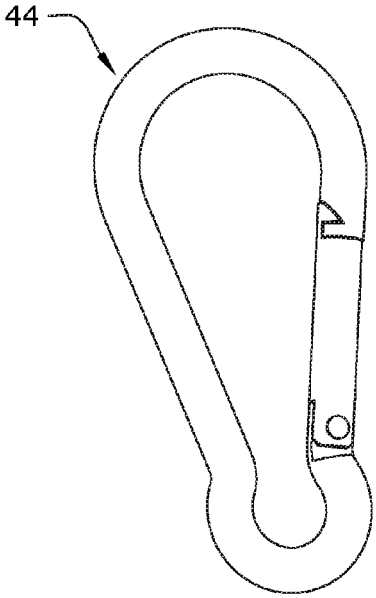
FIG. 12 is a representative embodiment of a snap link.
Figure 13:
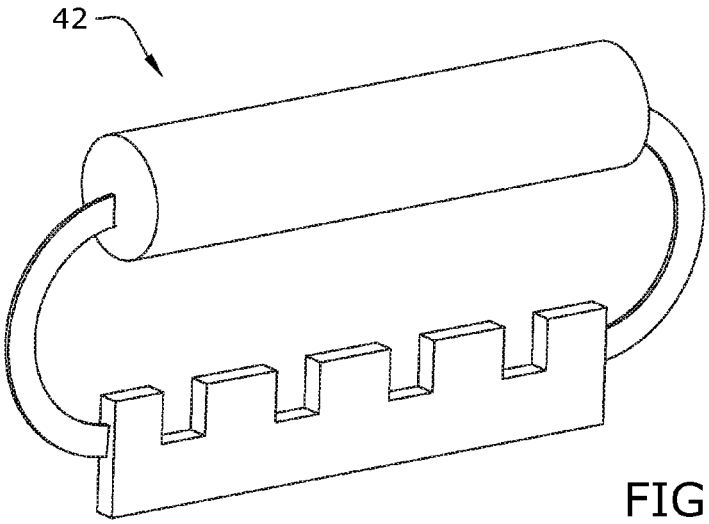
FIG. 13 is a representative embodiment of a handle.

A third exercise configuration is shown in reference to FIGS. 9-10. In this configuration, the backrest 20 is positioned in a substantially upright condition. The free end of the support arm 26 is positioned in abutment with the stop 34. In this configuration, the longitudinal orientation of the bench has been reversed with respect to the positioning of the first section 10 and the second section 12 such that the attachment points 18 are positioned proximal to the seat 22 rather than the back rest.

As will be appreciated, the system of the present invention may be arranged in a myriad of positions to configure the apparatus for a virtually unlimited number of exercises. While the embodiments shown illustrate the top 10, middle 12 and bottom 14 portions in combination. They may also be configured individually or in separate pairs.

For example, the top portion 10 may be placed by itself on the floor with the attachment points 18 oriented upwardly. The user may then stand on the intermediate portion of the first section 10 and perform standing exercises, with one or more exercise accessories secured to the attachment points 18. In like manner, the third section 14 may be utilized individually by placing it on the floor, permitting the user to utilize the bench as, for example a sit up board. The second section 12 and the third section 14 could also be configured in an inverted position, so that the bottom surface of the base 21 is received in an inverted second section 12, to form a stepping platform.

It should be understood, of course, that the foregoing relates to exemplary embodiments of the invention and that modifications may be made without departing from the spirit and scope of the invention as set forth in the following claims.

What is claimed is:

1. A configurable exercise apparatus, comprising:

a first section formed as an elongate plate having a substantially flat first side surface and a plurality of attachment points extending from a second side surface;

a second section having opposed upstanding sidewalls, a top opening at an upper end of the opposed upstanding sidewalls, a bottom opening at a lower end of the opposed upstanding sidewalls, wherein the first section is configured to be removably received in the top opening as a closure of the top opening when the apparatus is configured in a stowed condition, and wherein the first section is configured to be removably received in the bottom opening when the apparatus is configured in an exercise configuration; and a third section having a base having an upstanding frame wall extending interiorly from a periphery of the base, the upstanding frame wall dimensioned to support a bench back rest and a bench seat, and to be removably received within the bottom opening of the second section when the apparatus is configured in a stowed condition.

2. The configurable exercise apparatus of claim 1, wherein the plurality of attachment points extend from a first end portion and a second end portion of the second side surface.

3. The configurable exercise apparatus of claim 2, wherein the second side surface further comprises a slot separating the first end portion and the second end portion from an intermediate portion.

4. The configurable exercise apparatus of claim 3, wherein the second section further comprises:

a notch formed in a bottom edge surface of the opposed upstanding sidewalls, the notch dimensioned to receive the intermediate portion of the first section; and the slot is dimensioned to receive the bottom edge surface of the opposed upstanding sidewalls within the notch.

5. The configurable exercise apparatus of claim 4, wherein the third section further comprises a peripheral lip extending from a lateral edge surface of the base, wherein a bottom surface of peripheral lip is supported the top edge surface of the opposed upstanding sidewalls when the third section is configured on top of the second section.

6. The configurable exercise apparatus of claim 4, wherein the third section further comprises a peripheral lip extending from a lateral edge surface of the base, wherein the a top surface of peripheral lip supports the bottom edge surface of the opposed upstanding sidewalls when the second section is configured on top of the third section.

7. The configurable exercise apparatus of claim 1, further comprising:

an exercise accessory including a band, a handle, and a snap link.

8. The configurable exercise apparatus of claim 7, wherein the exercise accessory is secured to at least one of the plurality of attachment points.

9. The configurable exercise apparatus of claim 1, further comprising:

a pair of ground transport wheels operatively attached to at least one end of the apparatus.

10. The configurable exercise apparatus of claim 1, wherein the bench back rest is pivotally attached to the bench seat.

11. The configurable exercise apparatus of claim 1, wherein the second section further comprises a storage tray supported within an interior cavity of the second section.

* * * * *